US011460196B2

(12) United States Patent
Yang

(10) Patent No.: US 11,460,196 B2
(45) Date of Patent: Oct. 4, 2022

(54) LOW-CARBON SELF-BALANCE COOKING FUME PURIFIER

(71) Applicant: ZHONGSHAN CALCULUS SCIENCE AND TECHNOLOGY LTD, Zhongshan (CN)

(72) Inventor: Zhao Yang, Nanjing (CN)

(73) Assignee: ZHONGSHAN CALCULUS SCIENCE AND TECHNOLOGY LTD, Zhongshan (CN)

( * ) Notice: Subject to any disclaimer, the term of this patent is extended or adjusted under 35 U.S.C. 154(b) by 90 days.

(21) Appl. No.: 16/767,156

(22) PCT Filed: Nov. 16, 2018

(86) PCT No.: PCT/CN2018/116050
§ 371 (c)(1),
(2) Date: May 27, 2020

(87) PCT Pub. No.: WO2019/101022
PCT Pub. Date: May 31, 2019

(65) Prior Publication Data

US 2020/0386415 A1 Dec. 10, 2020

(30) Foreign Application Priority Data

Nov. 27, 2017 (CN) ..... 201711203711.9

(51) Int. Cl.
*F24C 15/20* (2006.01)

(52) U.S. Cl.
CPC ..... *F24C 15/2042* (2013.01); *F24C 15/2021* (2013.01); *F24C 15/2028* (2013.01); *F24C 15/2035* (2013.01); *F24C 15/2064* (2013.01)

(58) Field of Classification Search
CPC .. F24C 15/20; F24C 15/2021; F24C 15/2028; F24C 15/2035; F24C 15/2042; F24C 15/2064
(Continued)

(56) References Cited

U.S. PATENT DOCUMENTS 4,363,642 A * 12/1982 Stahl ..... F24C 15/20 126/299 E
5,906,195 A * 5/1999 Georgaras ..... F24C 15/20 126/299 D
(Continued)

FOREIGN PATENT DOCUMENTS

CN 102183056 A 9/2011
CN 202452553 U 9/2012
(Continued)

*Primary Examiner* — Ko-Wei Lin
(74) *Attorney, Agent, or Firm* — Bayramoglu Law Offices LLC

(57) ABSTRACT

A low-carbon self-balance cooking fume purifier includes a power system composed of a fume extraction fan, a blower fan configured to exhaust cooking fumes, an air curtain fan, a check valve actuator, a control circuit and an intelligent controller; a fume exhaust system composed of a plenum chamber, the blower fan configured to exhaust the cooking fumes, and a check valve; a silencing system composed of a fume pre-filter, a silencer, the plenum chamber, and an air curtain system; and an energy-saving system composed of an air curtain inlet duct, an air curtain outlet duct, and the air curtain fan. A stove cabinet, a disinfection cabinet and an oven or a steam cooker are integrated in the low-carbon self-balance cooking fume purifier.

15 Claims, 4 Drawing Sheets

(58) Field of Classification Search
USPC ..... 126/299 R, 299 D, 299 F; 454/56, 67
See application file for complete search history.

(56) References Cited

U.S. PATENT DOCUMENTS

| | | | | |
|---|---|---|---|---|
| 5,983,888 | A * | 11/1999 | Anselmino | F04D 29/664 126/299 D |
| 6,428,408 | B1 * | 8/2002 | Bell | B01L 1/50 454/56 |
| 9,222,680 | B1 * | 12/2015 | Woodall, III | F24C 15/20 |
| 2003/0162491 | A1 * | 8/2003 | Kanaya | F24F 7/08 454/252 |
| 2004/0194776 | A1 * | 10/2004 | Amir | F24C 15/2021 126/299 R |
| 2006/0154590 | A1 * | 7/2006 | Kanaya | F24F 7/06 454/56 |
| 2006/0175322 | A1 * | 8/2006 | Beak | F24C 15/20 219/757 |
| 2008/0110339 | A1 * | 5/2008 | Kwok | F24C 15/2035 95/31 |
| 2009/0013989 | A1 * | 1/2009 | Brown | F24C 15/2057 126/299 E |
| 2009/0178662 | A1 * | 7/2009 | Deng | F24C 15/2042 126/5 |
| 2009/0211564 | A1 * | 8/2009 | Pan | F24C 15/2028 126/299 D |
| 2009/0269219 | A1 * | 10/2009 | Langbein | F24C 15/20 417/312 |
| 2011/0094497 | A1 * | 4/2011 | Schrock | F24C 15/2028 126/299 D |
| 2011/0284091 | A1 * | 11/2011 | Livchak | F24F 7/06 137/2 |
| 2012/0018246 | A1 * | 1/2012 | Pietro | G10K 11/17857 181/224 |
| 2012/0055460 | A1 * | 3/2012 | Lambertson | F24F 13/1413 126/299 D |
| 2013/0149947 | A1 * | 6/2013 | Bagwell | F24C 15/2028 454/49 |
| 2014/0326145 | A1 * | 11/2014 | McEvoy | F24C 15/2035 99/331 |
| 2016/0131366 | A1 * | 5/2016 | Chen | H05B 6/6423 126/299 D |
| 2018/0135864 | A1 * | 5/2018 | Hanazono | G10K 11/17819 |

FOREIGN PATENT DOCUMENTS

| | | | |
|---|---|---|---|
| CN | 103353138 | A | 10/2013 |
| CN | 104676697 | A | 6/2015 |
| CN | 106247422 | A | 12/2016 |
| CN | 106482186 | A | 3/2017 |
| CN | 206386986 | U | 8/2017 |
| CN | 107781886 | A | 3/2018 |
| DE | 3519189 | A1 | 12/1986 |
| EP | 1967796 | A1 | 9/2008 |
| EP | 2090835 | A2 | 8/2009 |
| EP | 2518412 | A2 | 10/2012 |
| EP | 2864709 | A1 | 4/2015 |
| FR | 2493966 | A1 | 5/1982 |
| JP | 2000201829 | A | 7/2000 |

* cited by examiner

LOW-CARBON SELF-BALANCE COOKING FUME PURIFIER

CROSS REFERENCE TO THE RELATED APPLICATIONS

This application is the national phase entry of International Application No. PCT/CN2018/116050, filed on Nov. 16, 2018, which is based upon and claims priority to Chinese Patent Application No. 201711203711.9, filed on Nov. 27, 2017, the entire contents of which are incorporated herein by reference.

TECHNICAL FIELD

The present invention belongs to the technical field of integrated devices for purifying cooking fumes, and more particularly, relates to a low-carbon self-balance cooking fume purifier.

BACKGROUND

Existing range hoods and integrated stoves generally work by merely exhausting the mixed gas of cooking fumes and air from the indoors to the outdoors. When doors and windows remain closed, the use of the range hood and the integrated stoves may cause an indoor negative pressure, and may exhaust indoor heating air or cooling air as well. This thereby results in significant energy loss, and even rarefied air with oxygen deficit, thus posing a potential safety hazard that cannot be overlooked.

In winter and summer, numerous users close their doors and windows even when a range hood or integrated stove is working, in order to avoid the escape of heating air or cooling air. This may cause oxygen deficit and rarefied air, and significantly diminish the fume exhaust effect of the range hood and integrated stove, along with the large loss of heating air or cooling air.

The following examples illustrate the energy waste caused by range hoods and integrated stoves during operation.

Assuming that the temperature difference between indoor and outdoor is 15° C. when the range hood and the integrated stove is working, the exhaust air rate of the range hood and integrated stove is 1200 cubic meters per hour, the wasted energy Q of cooling air or heating energy when the range hood or the integrated stove operates for one hour is expressed by $Q=cm\Delta t$, the environmental energy consumption Q during the one-hour operation of the range hood and the integrated stove is roughly calculated as follows: $Q=cm\Delta t$, where, c=1000 J/(kg·° C.), m=1.29 kg/$m^3$*1200 $m^3$=1548 kg, $\Delta t$=15° C., i.e., the environmental energy consumption Q caused by the range hood or the integrated stove operating for one hour is Q=2.322×10-7 joules, equivalent to the electric meter reading of 6.45 kilowatt-hour calculated on the unit conversion that one kilowatt-hour is equivalent to the energy of 3.6 million joules.

In general, the direct power consumption of the range hood and integrated stove does not exceed 0.5 kWh/hour. The environmental energy consumption of the range hood and integrated stove operating for one hour, via a simple calculation, is 10 times more than their own energy consumption. Moreover, the range hood and integrated stove are not equipped with effective filtering modules, harmful particles in cooking fumes are often exhausted directly to the outdoors, greatly polluting the air along with severe noise pollution.

In summary, the prior art has the problem that the environmental energy consumption of the existing range hood and integrated stove operating for one hour is 10 times more than their own energy consumption. Besides, the range hood and integrated stove are not equipped with effective filtering modules, harmful particles in the cooking fumes are often exhausted directly to the outdoors, greatly polluting the air along with severe noise pollution.

SUMMARY

To solve the above-mentioned problems of the prior art, the present invention provides a low-carbon self-balance cooking fume purifier.

The present invention is achieved by the following technical solutions. The low-carbon self-balance cooking fume purifier includes:

a power system, including a fume extraction fan, a blower fan, an air curtain fan, a check valve actuator, a control circuit and an intelligent controller; wherein the blower fan is configured to exhaust cooking fumes; the fume extraction fan, a plenum chamber and the air curtain fan constitute a fume extraction system;

a fume exhaust system, including the plenum chamber, the blower fan configured to exhaust the cooking fumes, and a check valve;

a silencing system, including a pre-filter, a silencer, the plenum chamber, and an air curtain system; and an energy-saving system, including an air curtain inlet duct, an air curtain outlet duct, and the air curtain fan.

Further, a stove cabinet, a disinfection cabinet and an oven or a steam cooker are integrated in the low-carbon self-balance cooking fume purifier.

Further, the air curtain fan in the power system is installed on the air curtain inlet duct. The upper end of the air curtain fan is connected to the fume extraction fan. The upper end of the fume extraction fan is connected to the blower fan. The check valve actuator is installed at the air outlet of the blower fan.

The control end of the fume extraction fan, the control end of the blower fan, the control end of the check valve actuator, and the control end of the air curtain fan are electrically connected to the intelligent controller.

Further, a silencing device is provided outside the blower fan of the fume exhaust system. The plenum chamber is provided outside the silencing device. The pre-filter is provided at the upstream end of the air inlet of the fume extraction fan.

The upper end of the air curtain fan of the energy-saving system is provided with the air curtain inlet duct. The downstream end of the air curtain outlet duct is mounted with an air curtain outlet.

Further, the lower end of the pre-filter of the silencing system is welded to a frame. A cooktop is arranged at the lower end of the frame. A stove is embedded into the surface of the cooktop.

Further, the silencer includes a silencer body. A silencer outer cover is wrapped outside the silencer body. A silencer inner lining cover is wrapped inside the silencer. A silencing material is sandwiched between the outer cover and the inner cover.

Further, the air outlet of the fume extraction fan and the air inlet of the blower fan are connected through the internal space of the plenum chamber. The air outlet of the fume extraction fan and the air curtain inlet are connected through the internal space of the plenum chamber. The air curtain air flow is derived from the air flow exhausted from the fume extraction fan.

Further, the upstream end of the pre-filter is provided with a fume inlet, and a filter body is built into the pre-filter by a filter frame.

Condensate deflectors are arranged at intervals and in parallel under the bottom surface of the pre-filter. An oil box is installed at the lower end of the pre-filter. A lighting lamp is embedded at the upper end of the pre-filter. A switch panel is embedded on the upper side of the lighting lamp.

Further, the lower end of the silencer is installed above the air outlet of the fume extraction fan and fixed on the bottom plate of the plenum chamber. A control circuit box is wrapped outside the control circuit. The downstream end of the check valve is installed with a fume exhaust pipe. The downstream end of the air curtain fan is provided with the air curtain outlet.

Another objective of the present invention is to provide a purification system for a kitchen or a dining room, mounted with the low-carbon self-balance cooking fume purifier.

The advantages of the present invention are as follows. The low-carbon self-balance cooking fume purifier outperforms the range hood and integrated stove in terms of the fume extraction, and has the functions of the integrated stove and disinfection cabinet (steam cooker or oven). The cooking fumes undergo two-stage filtration without the need to clean the purifier body, thereby mitigating the pollution of cooking fumes to the atmosphere. The silencer and plenum chamber are designed to significantly reduce noise pollution. The fume extraction fan, the plenum chamber and the blower fan are successively connected in series. Dynamic pressure brought by the exhaust air of the fume extraction fan is converted into static pressure through the plenum chamber, and then the exhaust air is further pressurized by the blower fan, so that the air flow exhausted from the purifier obtains a greater potential energy to overcome the resistance of the fume exhaust pipe and the common flue. The air flow entering the plenum chamber is diverted into the air curtain system through the air curtain inlet duct, and is conveyed into the air curtain outlet duct through the air curtain fan to form an air curtain on the upstream end and both sides of the stove, and the air curtain functions along with the negative pressure zone generated during the operation of the fume extraction fan to wrap and convey the cooking fumes to the fume extraction fan through the pre-filter, so as to suppress the diffusion of cooking fumes, prevent the escape of cooking fumes, prevent the indoor air from being exhausted to the outdoors, and avoid the waste of environmental energy, the reduction of working efficiency, and the potential safety hazard of indoor oxygen deficit caused by the operation of the fume purifier.

The comprehensive energy consumption of the present invention is less than one tenth of that of the existing range hood and integrated stove.

The present invention provides a healthy, low-carbon, environmentally friendly and safe home life guarantee for a vast number of users.

Figure 1:
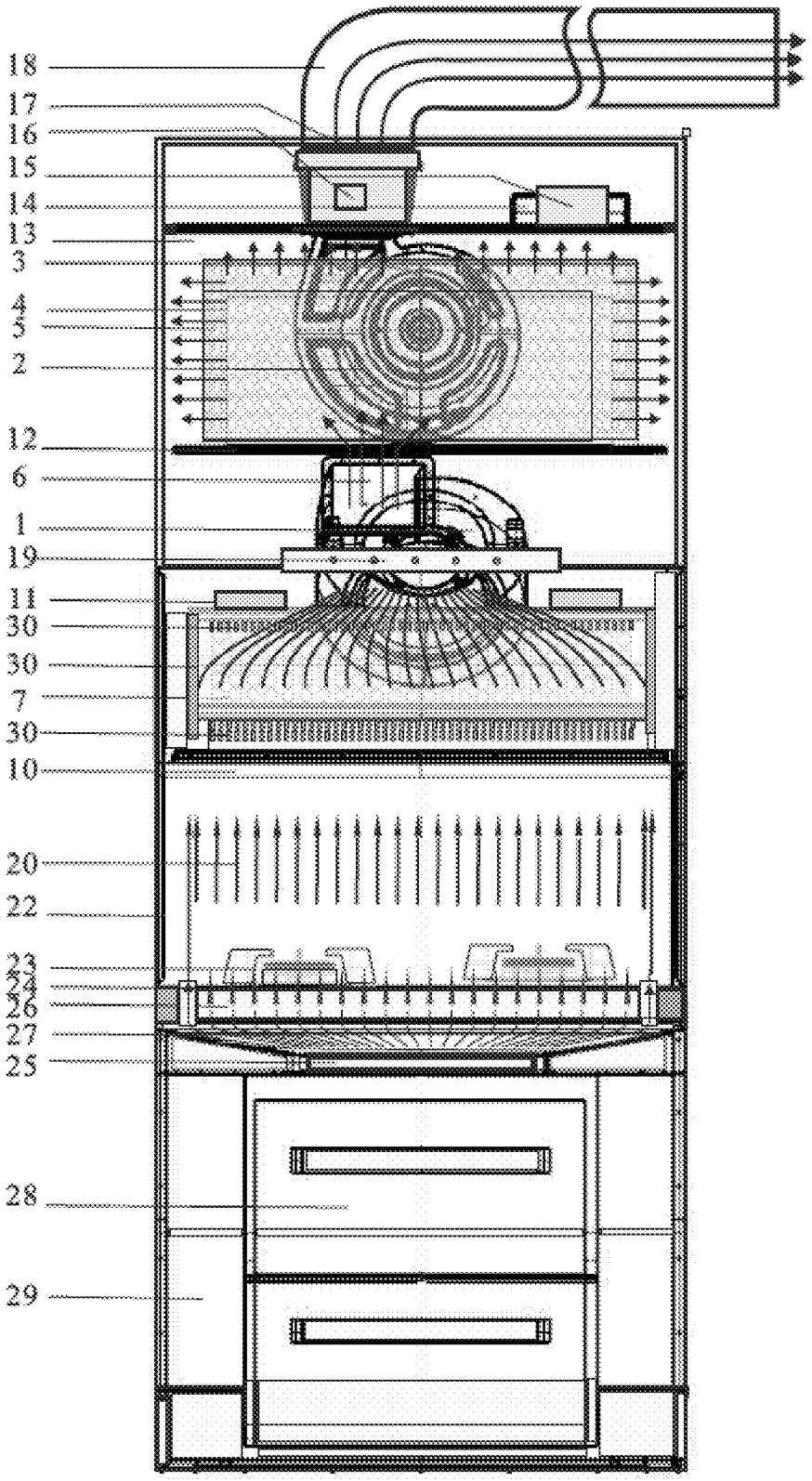
FIG. 1 is a structural schematic diagram of the low-carbon self-balance cooking fume purifier according to an embodiment of the present invention.
Figure 2:
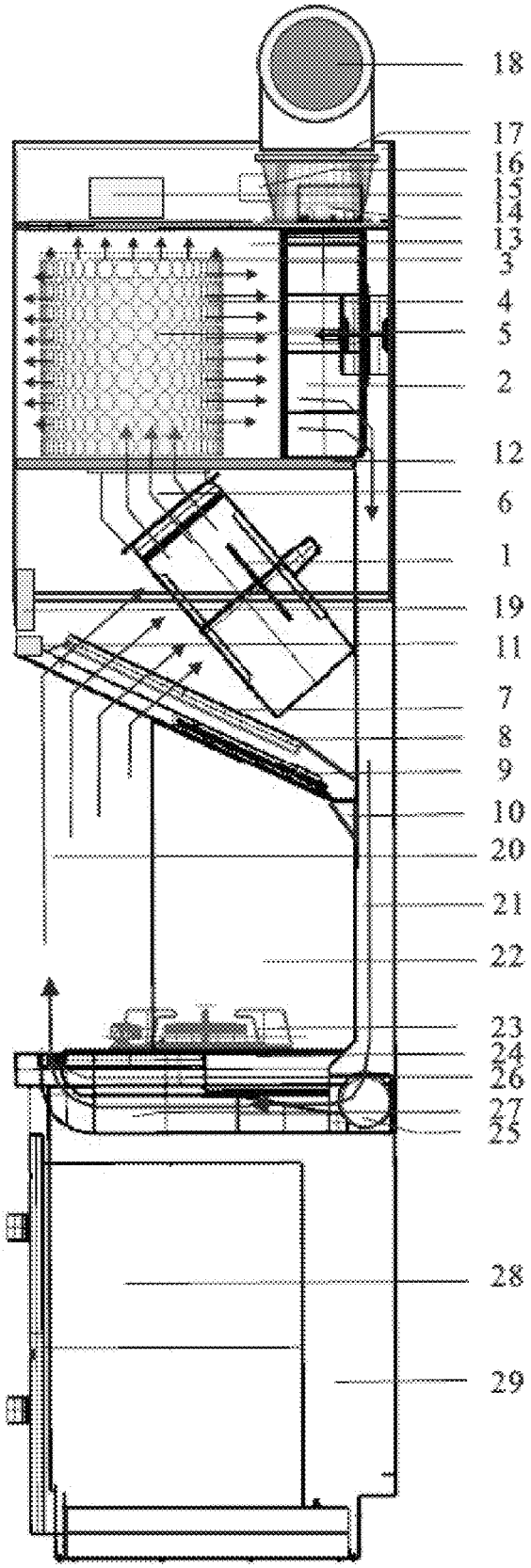
FIG. 2 is a side view of the low-carbon self-balance cooking fume purifier according to an embodiment of the present invention.
Figure 3:
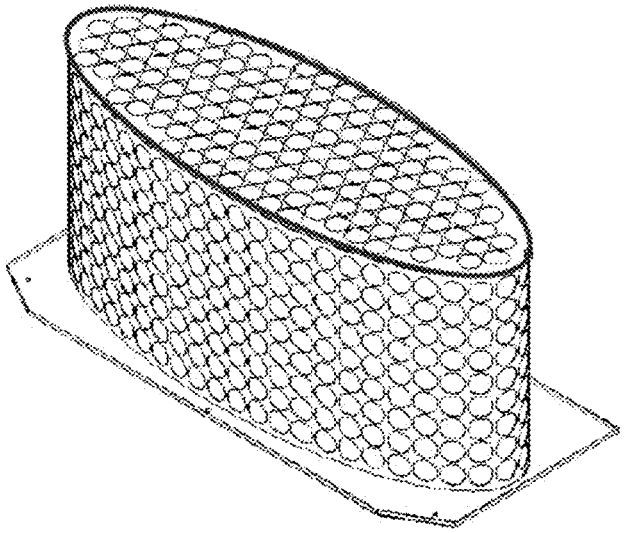
FIG. 3 is a perspective view of the silencer of the low-carbon self-balance cooking fume purifier according to an embodiment of the present invention.
Figure 4:
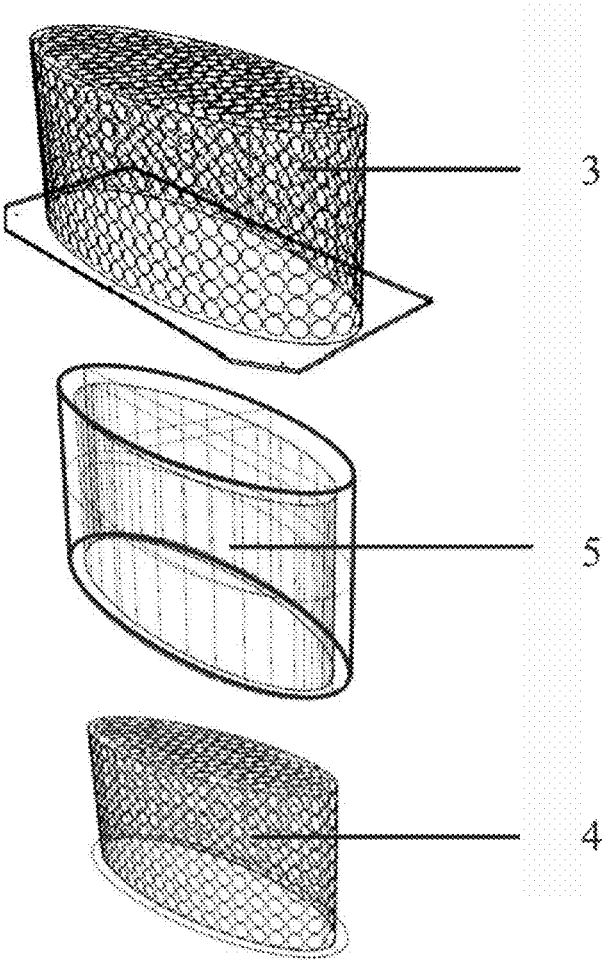
FIG. 4 is an exploded view of the silencer of the low-carbon self-balance cooking fume purifier according to an embodiment of the present invention.

In the figures: 1, fume extraction fan; 2, blower fan; 3, silencer outer cover; 4, silencer inner lining cover; 5, silencing device; 6, connecting flange; 7, pre-filter; 8, filter body; 9, condensate deflector; 10, oil box; 11, lighting lamp; 12, bottom plate of plenum chamber; 13, plenum chamber; 14, control circuit box; 15, intelligent controller; 16, check valve actuator; 17, check valve; 18, fume exhaust pipe; 19, switch panel; 20, air curtain air flow; 21, air curtain inlet duct; 22, frame; 23, stove; 24, cooktop; 25, air curtain fan; 26, air curtain outlet; 27, air curtain outlet duct; 28, disinfection cabinet, oven or steam cooker; 29, stove cabinet; 30, fume inlet.

DETAILED DESCRIPTION OF THE EMBODIMENTS

In order to make the objectives, technical solutions and advantages of the present invention clearer, hereinafter, the present invention will be further described in detail with reference to the embodiments. It should be understood that the specific embodiments described herein are only used to explain the present invention rather than to limit the present invention.

The application principle of the present invention will be further described below with reference to FIGS. 1-6 and the specific embodiments.

The fume extraction fan 1 and the check valve 17 are located outside the plenum chamber 13. The silencer and the blower fan 2 are located inside the plenum chamber 13. The air curtain inlet duct is connected to the plenum chamber 13. The oil box 10 is installed at the lower end of the filter body 8.

The control circuit box 14 is wrapped outside the control circuit. The fume inlet 30 is installed at the upstream end of the pre-filter 7. The check valve actuator 16 is installed on the check valve 17. The lower end of the pre-filter 7 is welded to the frame 22. The cooktop 24 is provided at the lower end of the frame 22. The stove 23 is embedded into the surface of the cooktop 24.

The air outlet of the fume extraction fan 1 is hermetically connected to the plenum chamber 13 by the connecting flange 6. The air outlet is located at the bottom of the silencer. The fume flow is diverged inside the plenum chamber 13. A part of the fume flow flows into the air curtain inlet duct to form the air curtain, and the remaining part of the fume flow enters the blower fan 2 and is exhausted to the outdoors.

The air curtain inlet duct 21, the air curtain fan 25, the air curtain outlet duct, and the air curtain outlet 26 constitute an air curtain generator. The air curtain outlet 26 is located on the cooktop.

During the operation of the fume extraction fan 1, the intelligent controller 15 controls the actuator to open the check valve 17 and simultaneously activate the blower fan 2 and the air curtain fan 25. When the power supply is turned off, the fume extraction fan 1 is stopped, and the intelligent controller 15 closes the electric check valve 17, and simultaneously stops the blower fan 2 and the air curtain fan 25.

The silencer includes the silencer outer cover 3, the silencer inner lining cover 4 and the silencing device 5. The silencing device 5 is sandwiched between the outer cover and the lining cover.

Cooking fumes are mainly composed of four parts, including exhaust gas generated by fuel combustion, food material spills, water vapor, and gasified greases generated by high-temperature pyrolysis. The cooking fume purifier fully extracts the cooking fumes first to prevent the cooking fumes from diffusing to the indoors and polluting the indoor environment, then removes greases and particulate matters from the cooking fumes, and then completely exhausts the cooking fumes extracted by the fume extraction fan 1 to the outdoors.

The power system is arranged based on an adequate study of the cooking fume generation and diffusion mechanism in combination with various kitchen structures and resistance conditions in the common flue. The air volume of the fume extraction fan 1 is equal to the sum of the air volume of the blower fan 2 and the air volume of the air curtain fan 25. The air volume of the blower fan 2 is the maximum amount of cooking fumes generated during cooking. When the air volume of the air curtain fan 25 is equal to the maximum amount of cooking fumes generated during cooking, a minimum air flow required for generating an effective negative pressure zone, suppressing the diffusion of cooking fumes and preventing the escape of cooking fumes during the operation of the fume extraction fan 1 should be ensured. Also, the working air volumes of all fans of the device can be automatically controlled by detecting the amount of the generated cooking fumes. The above-mentioned power configuration is to thoroughly extract the cooking fumes at the lowest energy consumption of the present invention, and to overcome the resistance generated by fume filtering, the silencer, the fume exhaust pipe, and the common flue to fully exhaust the cooking fumes with less or zero indoor air consumption, so as to avoid the waste of indoor cooling air and heating air caused by the operation of the device, and minimize the environmental energy consumption, which is green and low carbon.

The power system realizes low air volume and high-pressure configuration. The inventor has carried out studies on the absolute amount of cooking fumes, the thermodynamic movement of the cooking fumes, and the measurement of the diffusion velocity of the cooking fumes in the air in the thermodynamics laboratory at the University of Greenwich, and found that the absolute amount of cooking fumes instantly generated during stir frying for Chinese cooking in a domestic kitchen is less than 5 cubic meters per minute.

The plenum chamber 13, the blower fan 2 for exhausting cooking fumes, and the check valve 17 constitute a fume exhaust system. During the operation of the fume extraction fan 1, a negative pressure zone is formed outward at the air inlet of the fume extraction fan, the cooking fumes are guided to the air inlet of the fume extraction fan 1 due to the negative pressure and thermodynamic action. The cooking fumes, however, diffuse to the surroundings concurrently under the thermodynamic action by means of pressure difference, concentration difference, temperature difference and density difference. A large extract volume is required to quickly extract the cooking fumes in order to suppress the diffusion, but a large exhaust volume is needed to match the large extract volume. In addition to requiring large power of the fume extraction fan 1, the exhaust volume is also restricted by the diameter and length of the fume exhaust pipe and resistance of the common flue. Experiments have proven that if cooking fumes extracted by the fume extraction fan 1 cannot be completely exhausted, then partial cooking fumes may escape from the air inlet of the fan impeller, which destroys the effective negative pressure zone for extracting the cooking fumes, resulting in incomplete conditions for fully suppressing the cooking fumes and preventing the escape of the cooking fumes. In such case, the fume extraction fan 1 cannot completely extract the cooking fumes. The plenum chamber 13, the air curtain fan 25 and the blower fan 2 reduce the exhaust resistance of the fume extraction fan 1 while absolutely diverging the air flow exhausted from the fume extraction fan without the occurrence of backflow that damages the negative pressure zone. The cooking fumes exhausted from the fume extraction fan 1 partially flow through the air curtain air duct, and are diverged and pressurized by the air curtain fan 25 to form a high static pressure air curtain and a high dynamic pressure air curtain, which prevents the indoor air from entering the negative pressure zone for extracting the cooking fumes, and wraps the cooking fumes at the same time, so as to suppress the diffusion of the cooking fumes, prevent the cooking fumes from escaping, and promote the cooking fumes to quickly enter the fume extraction fan 1. Thereby, the fume extraction fan can completely extract the cooking fumes.

According to the above-mentioned description, if the cooking fumes cannot be exhausted completely, as a result, the cooking fumes cannot be extracted completely as well. Therefore, the full evacuation of cooking fumes is also an important part of the present invention. The plenum chamber 13 converts the dynamic pressure of the fume flow formed by the fume extraction fan 1 into static pressure to reduce the impact of the dynamic pressure on the fan impeller of the blower fan 2, and the high static pressure facilitates the operation of the blower fan 2. The excess fume flow excluding those forming the air curtain is pressurized definitely by the blower fan 2 to improve the potential energy of the air flow to overcome the resistance of the exhaust pipe and the common flue, so that the whole device can operate efficiently. The check valve 17 is driven by an electric actuator. The valve plate is opened by an angle of 90 degrees relative to the valve body. When the device works, the valve plate is completely opened without the resistance to the air flow. When the device is stopped, the valve plate is completely closed to thoroughly prevent the cooking fumes in the common flue from flowing backward. In addition, the device is connected to the common flue and therefore fire-resistant.

The pre-filter 7 and the silencer realize the two-stage filtration of the cooking fumes. Cooking fumes contain a large number of harmful substances mainly including organic substances generated by volatilization of food materials under the action of high-temperature grease, e.g., acrylamide, benzopyrene, butadiene, acrolein, nitro polycyclic aromatic hydrocarbons, and others. A part of these volatilized organic substances is in a free state and constitute the smells during cooking, and the remaining part of these volatilized organic substances is dissolved in the grease. During high-temperature stir frying, the moisture in the food materials quickly evaporates in response to the high-temperature grease. A large amount of water vapor mixed with the grease becomes rising mist under the thermodynamic action to form an aerosol composed of combustion exhaust, oil mist, water vapor, and organic volatiles. The freezing point of most of the organic volatiles in the cooking fumes is lower than 40 degrees. After volatilization, the condensed particles are mostly adsorbed by water vapor particles or dissolved in the grease. In the present invention, the filter and the silencer are both filter screens made from special flame-retardant puffed fibers with good air permeability. The thicknesses of the filter body 8 and the silencer are approximately 25 mm. This kind of material forms a large number of capillaries when expanding, and has a large specific surface area and strong adsorption capacity. After the two-stage filtration, it is experimentally determined that the condensed grease and water mist in the cooking fumes can be removed hundred-percent, so that the powered impeller and the inner chamber of the device are maintained clean as new, thereby ensuring efficient operation of all power devices. On the other hand, through filtration, the harmful substances in the cooking fumes are mostly absorbed by the filter material, which dramatically alleviates the pollution to the atmosphere caused by the direct exhaust of the cooking fumes. A professional researcher must point out, why can't the grease condensed on the surface of the fan impeller of the range hood and integrated stove be removed by the centrifugal effect of the impeller? The answer is because the grease has increased viscosity after being processed under the high temperature. On the other hand, the grease undergoes chemical thixotropy after being mixed with the solid particles in the cooking fumes. The fan impeller operates under the action of centrifugal force, the grease is solidified instantly and firmly adhered to the surface of the fan impeller to destroy the dynamic balance of the fan impeller, which diminishes the efficiency and service life of the range hood and integrated stove and increases the noise.

The pre-filter 7, the silencer, the plenum chamber 13 and the air curtain system constitute the silencing system. The silencing material used in this system is the same as that in the filter body 8. In the present invention, a large number of capillaries in the puffed fibers have a very strong damping and sound absorption effect on the dynamic noise and aerodynamic noise. The fibers slightly oscillate when the air flow passes therethrough to play a role in damping and sound absorption as well. The plenum chamber 13 converts the dynamic pressure of the air flow into the static pressure while effectively reducing the aerodynamic noise. The use of the air curtain system significantly reduces the flow rate of the present invention as well as reduces the aerodynamic noise. The above description is the principle of the silencing system of the present invention.

The air curtain inlet duct 21, the air curtain outlet duct 27, and the air curtain fan 25 constitute the energy-saving system. The air flow exhausted from the fume extraction fan 1 is used as the air curtain medium to prevent indoor air from being exhausted to the outdoors, and avoid or reduce the waste of indoor environmental energy caused by the operation of the device. On the other hand, the potential energy and kinetic energy obtained after the work on the cooking fumes by the fume extraction fan 1 is fully utilized by the air curtain. Moreover, the use of the energy-saving system significantly reduces the flow rate of the present invention and dramatically diminishes the power consumption of the system.

The stove cabinet 29 is integrated with the disinfection cabinet, oven or steam cooker 28 to fully save space and also endow the present invention with versatility. It should be noted that the disinfection cabinet (oven or steam cooker) of the present invention requires an independent power supply.

The fume extraction fan, the fume exhaust fan, the air curtain fan 25, the electric check valve actuator, the control circuit and the intelligent controller 15 constitute the power system. The working process of the power system is described as follows.

Figure 5:
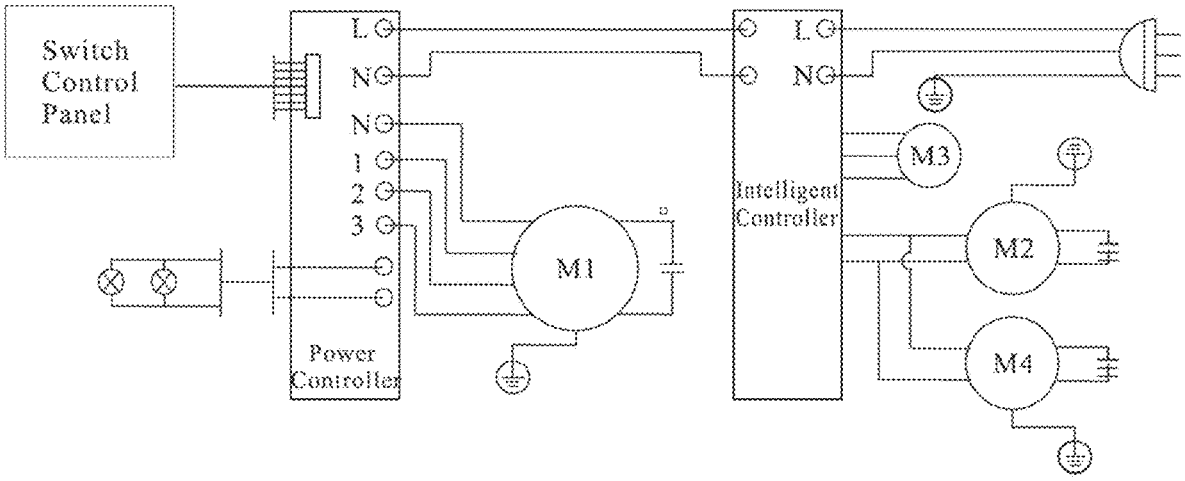
FIG. 5 is a circuit diagram of the control circuit of the low-carbon self-balance cooking fume purifier according to an embodiment of the present invention.
Figure 6:
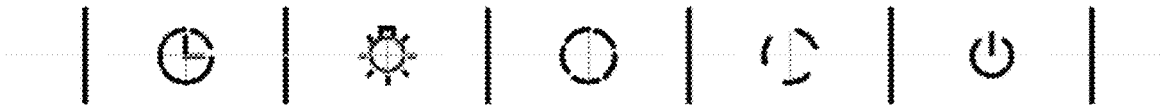
FIG. 6 is a schematic diagram showing the switch panel of the low-carbon self-balance cooking fume purifier according to an embodiment of the present invention.

As shown in FIG. 5 and FIG. 6, the switch button on the switch panel 19 is turned on, the power supply is turned on, the low-speed button or the high-speed button is turned on, and the fume extraction fan 1 works. Then, the intelligent controller 15 controls the actuator 16 to open the check valve 17, and simultaneously activate the blower fan 2 (M2) and the air curtain fan 25 (M4). When the power supply is turned off, the fume extraction fan 1 is stopped, then the intelligent controller 15 closes the electric check valve 17, and simultaneously stops the blower fan 2 (M2) and the air curtain fan 25 (M4).

It should be noted that the intelligent controller 15 of the present invention is a mature product that has been developed by the inventor. The intelligent controller 15 can automatically increase or decrease the pressure according to the resistance of the fume exhaust pipe 18 and the kitchen common flue and automatically control the flow rates of M2 and M4 simultaneously, to completely exhaust the cooking fumes in the plenum chamber 13 at the lowest energy consumption. At present, the intelligent controller 15 is available in domestic and foreign markets, and thus the circuit design principle and computer control program of the intelligent controller 15 are not described in the present invention.

Before cooking, the power switch button on the switch panel 19 is turned on, the power light is on, the circuit is connected, and the lighting lamp 11 is turned on. The low-speed button or the low-speed button is turned on according to the alternative cooking modes, and the low-carbon self-balance cooking fume purifier of the present invention starts to work.

When cooking starts, the cooking fumes are generated from the stove 23, and the cooking fume flow rises under the combined action of the thermodynamic action, the negative pressure generated during the operation of the fume extraction fan 1, and the air curtain air flow 20. Under the action of the negative pressure generated by the fume extraction fan 1, the air curtain air flow 20 and the cooking fumes are mixed in the negative pressure zone, and guided by the condensate deflectors 9 to flow into the pre-filter 7 along the fume inlets 30 distributed on the condensate deflectors 9. The fume gas is filtered by the filter body 8, so that condensed matters including the solid particulate matters and liquid particulate matters in the fume gas are mostly adsorbed by the filter body 8. The filtered fume gas is extracted into the fume extraction fan 1, and the fume gas entering the fume extraction fan 1 does not contain condensed substances that may be adhered to the fan impeller of the fume extraction fan 1. The work on the fume gas is done by the fume extraction fan 1, and the fume gas exhausted from the fume extraction fan 1 obtains a relatively high flow rate and static pressure. The work done by the fume extraction fan 1 produces aerodynamic noise, mechanical noise, and electromagnetic noise. The flow rate of the fume gas after being pressurized increases, which increases the friction noise between the fume gas and the components of the purifier body. The fume gas exhausted from the fume extraction fan 1 is conveyed to the silencer. The base of the silencer outer cover 3 is installed on the bottom plate 12 of the plenum chamber 13. The fume gas entering the inner cavity of the silencer is released to reduce the flow rate. The dynamic pressure of the fume gas is partially converted into static pressure, and the fume gas flow passes through the silencing device 5 of the silencer to undergo the secondary filtration, and flows into the plenum chamber 13 from the periphery and top of the silencer. The fume gas entering the plenum chamber 13 is released into a larger space, and the dynamic pressure of the fume gas flow is further converted into static pressure. A part of the fume gas in the plenum chamber 13 is extracted into the air curtain inlet 21 by the air curtain fan 25, and enters the air curtain outlet duct 27 after being pressurized by the air curtain fan 25, to form the air curtain 20 of the present invention. The remaining part of the fume gas is extracted by the blower fan 2 and exhausted to the outdoors through the check valve and the fume exhaust pipe 18. The noise generated during the use of the present invention mainly comes from the work of the fume extraction fan 1 and the blower fan 2 and the aerodynamic noise of the fume gas flow. Reduction of noise transmission into the room is achieved by noise absorption by the filter body 8 of the pre-filter 7 and the silencing device 5 inside the purifier body, the silencing effect of the silencer and the plenum chamber 13, and the partitioning of the purifier body. For long-term and efficient use of the product developed by the present invention, users need to replace the filter body 8 and the silencing device 5 irregularly.

When the cooking is ended, the delay button on the switch panel 19 is turned on or the power button is turned off. The stove and disinfection cabinet (steam cooker or oven) of the present invention employ independent power supplies, and are not linked with the power system of the present invention, thus can be used alone by users.

The above descriptions are only the preferred embodiments of the present invention and are not intended to limit the present invention. Any modifications, equivalent replacements and improvements made within the spirit and principle of the present invention shall fall within the scope of protection of the present invention.

What is claimed is:

1. A low-carbon self-balance cooking fume purifier, comprising:

a power system, comprising a fume extraction fan, an air curtain fan, a check valve actuator, a control circuit, and an intelligent controller;

a fume exhaust system, comprising a plenum chamber, a blower fan, and a check valve, wherein the blower fan is configured to exhaust cooking fumes;

a silencing system, comprising a pre-filter and a silencer, wherein the silencer comprises a silencing device sandwiched between a silencer outer cover and a silencer inner lining cover; and an energy-saving system, comprising an air curtain inlet duct and an air curtain outlet duct;

wherein the intelligent controller controls the check valve actuator to open the check valve, the fume extraction fan, the plenum chamber, and the air curtain fan are configured for fume extraction.

2. The low-carbon self-balance cooking fume purifier according to claim 1, wherein a stove cabinet and at least one of a disinfection cabinet, an oven and a steam cooker are integrated in the low-carbon self-balance cooking fume purifier.

3. The low-carbon self-balance cooking fume purifier according to claim 1, wherein the air curtain fan in the power system is installed on the air curtain inlet duct; the air curtain fan is fluidly connected to the fume extraction fan; the fume extraction fan is fluidly connected to the blower fan; the check valve actuator is installed at an air outlet of the blower fan; and the fume extraction fan, the blower fan, the check valve actuator, and the air curtain fan are controlled by and electrically connected to the intelligent controller.

4. The low-carbon self-balance cooking fume purifier according to claim 1, wherein the silencing device is provided outside the blower fan of the fume exhaust system; the plenum chamber is provided outside the silencing device; the pre-filter is provided at an upstream end of an air inlet of the fume extraction fan; and the air curtain fan is fluidly connected with the air curtain inlet duct; a downstream end of the air curtain outlet duct is fluidly connected with an air curtain outlet.

5. The low-carbon self-balance cooking fume purifier according to claim 1, wherein a lower end of the pre-filter of the silencing system is welded to a frame;

a cooktop is arranged at a lower end of the frame; and a stove is embedded into a surface of the cooktop.

6. The low-carbon self-balance cooking fume purifier according to claim 1, wherein an air outlet of the fume extraction fan and an air inlet of the blower fan are fluidly connected through an internal space of the plenum chamber;

the air outlet of the fume extraction fan and the air curtain inlet duct are fluidly connected through the internal space of the plenum chamber; and an air curtain air flow is derived from an air flow exhausted from the fume extraction fan.

7. The low-carbon self-balance cooking fume purifier according to claim 1, wherein an upstream end of the pre-filter is provided with a fume inlet, and a filter body is built into the pre-filter by a filter frame; and a plurality of condensate deflectors are arranged at intervals in parallel under a bottom surface of the pre-filter; an oil box is installed at a lower end of the pre-filter; a lighting lamp is embedded at an upper end of the pre-filter; a switch panel is embedded on an upper side of the lighting lamp.

8. The low-carbon self-balance cooking fume purifier according to claim 1, wherein a lower end of the silencer is installed above an air outlet of the fume extraction fan and fixed on a bottom plate of the plenum chamber;

a control circuit box is wrapped outside the control circuit;

a downstream end of the check valve is provided with a fume exhaust pipe; and a downstream end of the air curtain fan is fluidly connected with an air curtain outlet.

9. A purification system for a kitchen or a dining room, comprising the low-carbon self-balance cooking fume purifier according to claim 1.

10. The purification system according to claim 9, wherein a stove cabinet and at least one of a disinfection cabinet, an oven and a steam cooker are integrated in the low-carbon self-balance cooking fume purifier.

11. The purification system according to claim 9, wherein the air curtain fan in the power system is installed on the air curtain inlet duct; the air curtain fan is fluidly connected to the fume extraction fan; the fume extraction fan is fluidly connected to the blower fan; the check valve actuator is installed at an air outlet of the blower fan; and the fume extraction fan, the blower fan, the check valve actuator, and the air curtain fan are controlled by and electrically connected to the intelligent controller.

12. The purification system according to claim 9, wherein the silencing device is provided outside the blower fan of the fume exhaust system; the plenum chamber is provided outside the silencing device; the pre-filter is provided at an upstream end of an air inlet of the fume extraction fan; and the air curtain fan is fluidly connected with the air curtain inlet duct; a downstream end of the air curtain outlet duct is fluidly connected with an air curtain outlet.

13. The purification system according to claim 9, wherein a lower end of the pre-filter of the silencing system is welded to a frame;

a cooktop is arranged at a lower end of the frame; and a stove is embedded into a surface of the cooktop.

14. The purification system according to claim 9, wherein an air outlet of the fume extraction fan and an air inlet of the blower fan are fluidly connected through an internal space of the plenum chamber;

the air outlet of the fume extraction fan and the air curtain inlet duct are fluidly connected through the internal space of the plenum chamber; and an air curtain air flow is derived from an air flow exhausted from the fume extraction fan.

15. The purification system according to claim 9, wherein an upstream end of the pre-filter is provided with a fume inlet, and a filter body is built into the pre-filter by a filter frame; and a plurality of condensate deflectors are arranged at intervals in parallel under a bottom surface of the pre-filter; an oil box is installed at a lower end of the pre-filter; a lighting lamp is embedded at an upper end of the pre-filter; a switch panel is embedded on an upper side of the lighting lamp.

* * * * *